US005556178A

United States Patent [19]

Groebly

[11] Patent Number: 5,556,178

[45] Date of Patent: Sep. 17, 1996

[54] STORAGE RECEPTACLE FOR STORING OF OBJECTS IN A PLURALITY OF RECEPTACLES

[76] Inventor: Walter Groebly, Hoechweg, CH-8914 Aeugst, Switzerland

[21] Appl. No.: 248,888

[22] Filed: May 25, 1994

[30] Foreign Application Priority Data

May 26, 1993 [DE] Germany ..... 43 17 422.1

[51] Int. Cl.[6] ..... A47B 87/00

[52] U.S. Cl. ..... 312/107; 312/330.1

[58] Field of Search ..... 312/258, 261, 312/334.7, 334.22, 350, 351, 9.44, 108, 107

[56] References Cited

U.S. PATENT DOCUMENTS

| | | | |
|---|---|---|---|
| 2,599,240 | 6/1952 | Ellerson | 312/330.1 |
| 3,765,540 | 10/1973 | Serrano et al. | 312/330.1 |
| 4,960,307 | 10/1990 | Nelsen | 312/330.1 |

FOREIGN PATENT DOCUMENTS

| | | | |
|---|---|---|---|
| 0190237 | 10/1989 | European Pat. Off. . | |
| 0722403 | 3/1932 | France | 312/334.7 |
| 3428198 | 2/1986 | Germany . | |
| 4317422 | 12/1994 | Germany | 312/330.1 |

*Primary Examiner*—Peter M. Cuomo
*Assistant Examiner*—Gerald A. Anderson
*Attorney, Agent, or Firm*—Browdy and Neimark

[57] ABSTRACT

The invention relates to a storage receptacle with a rear wall and a front wall as well as two lateral walls, in which guide rails are provided at equal heights for receiving and moving of further receptacles fitted in the storage receptacle, wherein at least one of the walls is embodied to be displaceable or pivotable and contains guide rails which, after displacement or pivoting of the wall, alignedly engage the guide rails of the respectively adjoining walls. The storage receptacle can also be arranged in the form of a longitudinal drawer in a piece of furniture and contains transverse drawers which can be pulled out of the storage receptacle crosswise to the pull-out direction.

20 Claims, 8 Drawing Sheets

1,54
2
3
5
6
47
48
49
50
51
52
53

STORAGE RECEPTACLE FOR STORING OF OBJECTS IN A PLURALITY OF RECEPTACLES

BACKGROUND OF THE INVENTION

1. Field of the Invention

The invention relates to a storage receptacle.

2. Prior Art

Such a storage receptacle has become known from U.S. Pat. No. 4,802,715 of present application, for example. This known kit is a storage receptacle consisting of a front wall, lateral walls and a rear wall. Guide grooves are cut opposite each other in the storage receptacle in horizontal planes on the lateral walls. The guide grooves are engaged by corresponding interior receptacles which are displaceable in the engaged guide grooves.

In this way it is possible to effectively utilize the interior of the storage receptacle of U.S. Pat. No. 4,802,715 because access openings between the various interior receptacles make possible displacement of the interior receptacles arranged on various levels in the storage receptacle. In this way it was possible, for example, to gain access to a receptacle behind other interior receptacles, such as those in the vicinity of the bottom, by displacing other interior receptacles located above it or in front of it.

This storage receptacle has proven itself effective and it has been shown that an even more improved utilization of available space in the storage receptacle is possible if the access openings between the individual receptacles are made small and are then increased by opening the storage receptacle.

OBJECT AND SUMMARY OF THE INVENTION

It is therefore the object of the invention to improve a storage receptacle of the type described in U.S. Pat. No. 4,802,715 in such a way that improved access to individual receptacles is possible with improved space utilization of the interior of the storage receptacle.

It is an essential feature of the invention that in accordance with the invention the front wall and, if required, the rear wall, too, are divided or undivided and are embodied to be pivotable around a vertical axis, wherein in accordance with the invention guide grooves are now also disposed on the insides of the said wall sections which, in the opened (pivoted open) state of these wall sections extend the guide grooves disposed on the lateral wall toward the front or back.

This results in a considerably improved space utilization of the interior of the storage chest, because in accordance with the invention it is now possible to open the front and rear walls, and the wall parts then constitute the continuation of the left and right lateral walls of the storage chest. Thus, the guide grooves in the lateral walls are continued as guide grooves in the front and rear walls. It is now possible for the first time to push the receptacles, which are displaceably carried in the guide grooves in the storage chest, toward the front past the front edge of the storage receptacle. These receptacles can now reach the area of the guide grooves of the pivoted-open front and rear walls.

This results in an essential increase in the access openings arranged in the storage chest. Thus, individual receptacles which are displaceably arranged in the storage chest, can now be pulled apart and an advantageous reach-through to the receptacles located at the bottom is made possible.

In this way it is possible to arrange the receptacles in the storage chest in the tightest space with minimum openings for reaching through, when the storage chest is closed. By opening the front wall and/or rear wall is it possible to pull individual receptacles into the area of the front wall and/or rear wall. Thus produces reach-through openings in the storage chest itself, through which it is optimally possible to reach individual receptacles.

Thus, the core of the invention lies in that selectively the front wall or the rear wall or both walls together are divided or undivided and are embodied to be pivotable around a vertical axis on the lateral walls of the storage chest. Guide grooves are disposed on the insides of the front wall or the rear wall, which are aligned with the guide grooves on the lateral walls of the storage chest itself.

For the sake of simplicity, the function of a front wall will now be described in the following description, wherein it is within the scope of the invention to embody the rear wall also in accordance with the invention.

It is not absolutely necessary for the attainment of the object that in the state of rest the front or rear wall closes off the interior of the storage chest. It can also be provided that the said front and rear walls are displaced parallel to the lateral walls or parallel to the bottom and top surfaces of the storage chest in order to be only then displaced, swiveled or pivoted toward the front into the position of use beyond the front edge of the storage chest, so as to assure an additional utilization of the space of the storage chest.

It is therefore provided in a first embodiment of the present invention that the front and rear walls are pivotably seated on vertical axes on the lateral walls of the storage chest, so that in the closed pivot position the storage chest is closed at the front and rear by the said walls, wherein these walls are pivoted open in the function position and form front wall and rear wall parts which the constitute the extension of the surface of the lateral walls toward the front and back.

In accordance with the above described embodiment, the front or rear walls are divided approximately at the center, so that two pivotable wings of the same length result, which at their respective lateral edges are pivotably seated on vertical axes at the front edges of the storage chest in a pivotable manner.

It is provided in accordance with a modified exemplary embodiment that the front and rear walls are not divided at their center areas, but that the vertical dividing line is disposed on the left and right side of the storage chest approximately in the vicinity of the vertical pivot axis. In this exemplary embodiment the length of the pivotable front wall and/or rear wall becomes twice as great as in the first described exemplary embodiment. The two wings of this front wall or rear wall therefore overlap and each wing has a length corresponding to the total width of the storage chest.

In a variant of the exemplary embodiment of FIGS. 1 to 3 it is provided—corresponding to the exemplary embodiment also modified in the general description part—that the center vertical parting line 11 is omitted and instead respectively one parting line for respectively one front part 7, 8 comes to lie in the vicinity of the vertical hinge pin 17.

In this way two front walls 7, 8 of equal length are formed, which have twice the length compared with the front wall parts 7, 8 shown in FIGS. 1 to 3.

These two front walls overlap each other and accordingly form an inner and outer front wall when in the pivoted-in state.

The left front wall 7 is—as in FIG. 1—pivotably seated in the left hinge pin 17, while the right front wall 8 is pivotably seated in the right hinge pin 17.

Therefore, in contrast to the first mentioned exemplary embodiment, these front walls 7, 8 are twice as long as the front wall parts shown in FIGS. 1 to 3.

In another embodiment of the invention it is provided that the front wall parts are displaceably held at the lateral walls parallel to the lateral wall surface and are pivoted by means of a connecting link guide in such a way that in the position of use they form a plane, aligned with the lateral walls, so that the guide grooves in the lateral walls are continued by the guide grooves at the insides of the front wall.

In a third embodiment it is provided that the lateral walls are disposed, pivotable in horizontal pivot axes, on a bottom panel, which bottom panel is pivotably maintained in guide grooves of the storage chest.

With this embodiment there is the advantage that a front panel can be continuously present, which is connected with the bottom panel and that the front panel continuously covers the front of the storage chest.

In contrast thereto it is provided in the exemplary embodiments previously described that appropriate front panels are laminated on the outsides of the front or rear wall in order to achieve a furniture-like appearance.

In a further embodiment of the invention it is provided that the front walls are maintained on the lateral walls via telescopic guides and otherwise are pivotably embodied, so that in their rest position they can be selectively displaced parallel to the bottom surface or remain parallel with the lateral wall.

In a further embodiment it is provided that the front walls are fastened on the lateral walls in a kind of pivot guide in order to be pivoted in this way in a pivot movement directed parallel to the lateral wall plane from an upper, raised position into a lower, let down position, which lower, let down position then extends the lateral walls toward the front in alignment.

It is again pointed out that all descriptions relating to the front wall relate in an analogous manner to the rear wall and that therefore modifications of the front wall and/or the rear wall are included in the present invention.

It is furthermore pointed out that all descriptions in which pivoting from an upper pivot position into a lower pivot position is performed can also be kinematically reversed in an analogous fashion, i.e., in this case instead of a top of the front wall performing an appropriate pivot movement, a lower edge of the front wall performs it in an analogous manner.

The present invention defines a "storage receptacle" in a general way such that this storage receptacle can be embodied as a piece of furniture. i.e., the lateral walls, rear walls and front walls mentioned in the following description can be directly parts of a wardrobe or other piece of furniture, wherein in this case the front wall (rear wall) embodied in accordance with the invention is itself the door of the piece of furniture. In accordance with the invention the inside of the door of the piece of furniture is provided with appropriate guide rails, so that when the door is opened into its position of use, the guide grooves provided on the inside are aligned with the guide grooves provided on the inside of the piece of furniture and that therefore a displacement of receptacles arranged in the interior is also given.

In a further embodiment of the invention it is provided that the storage receptacle as such is embodied as a chest which can be housed in a piece of furniture, a drawer, in a wardrobe, in a desk or the like.

The storage receptacle itself can also be embodied as a drawer, i.e. drawer guide rails can be disposed on the lateral walls of the storage receptacle, which maintain the storage receptacle displaceably in a piece of furniture.

The term "piece of furniture" is not to be understood as a limiting term, i.e. such a storage receptacle can also be a part of a refrigerator, a dishwasher, a freezer, paper storage, tool or replacement part storage, medicine cabinet or the like.

The present invention also relates to several options of arranging the storage receptacle of the invention in a drawer which preferably is displaceably maintained on telescoping rails in the body of a piece of furniture.

In a first embodiment it is preferred that the storage receptacle is disposed on telescoping rails in the body of a piece of furniture in such a way that it can be pulled parallel to the direction of its longitudinal axis out of the body of the piece of furniture with the aid of telescoping rails. In this case the longitudinal axis is defined as a parallel to the guide grooves of the storage chest.

In this first embodiment the front walls which can be tilted or pivoted out then form the front wall of the storage chest. This front wall is then to be opened in accordance with the teaching of the invention and the usable volume of the storage receptacle is to be increased accordingly.

In a second embodiment of the invention, however, a transverse displacement instead of a longitudinal displacement is described.

In this exemplary embodiment the storage receptacle is again seated on telescoping rails wherein, however, the long axis of the guide grooves is vertical to the (new) pull-out direction of the drawer. Accordingly, the storage receptacle is first pulled out of the body of the piece of furniture until its lateral walls come free. Now these lateral walls are tilted open or pivoted and make possible an increase of the usable volume of the storage receptacle in the transverse direction in respect to the pull-out direction of this storage receptacle.

In this connection a transverse displacement of the displaceable or pivotable walls, which are now to be defined as lateral walls, is proposed, wherein this displacement is preferably performed on telescopic rails.

In this way a transverse displacement (crosswise to the pull-out direction) of the lateral walls of the storage receptacle is proposed, after the storage receptacle has been pulled out of the body of the piece of furniture.

This results in the advantage that altogether the pull-out length of the storage receptacle is relatively short, because it needs only to be pulled out of the body of the piece of furniture sufficiently to displace the parallel lateral walls in the transverse direction and/or to open them.

BRIEF DESCRIPTION OF THE DRAWINGS

The invention will be described in detail below by means of the drawings which show only one way of execution.

In the process further characteristics important for the invention and advantages of the invention ensue from the drawings and their description.

Figure 1:
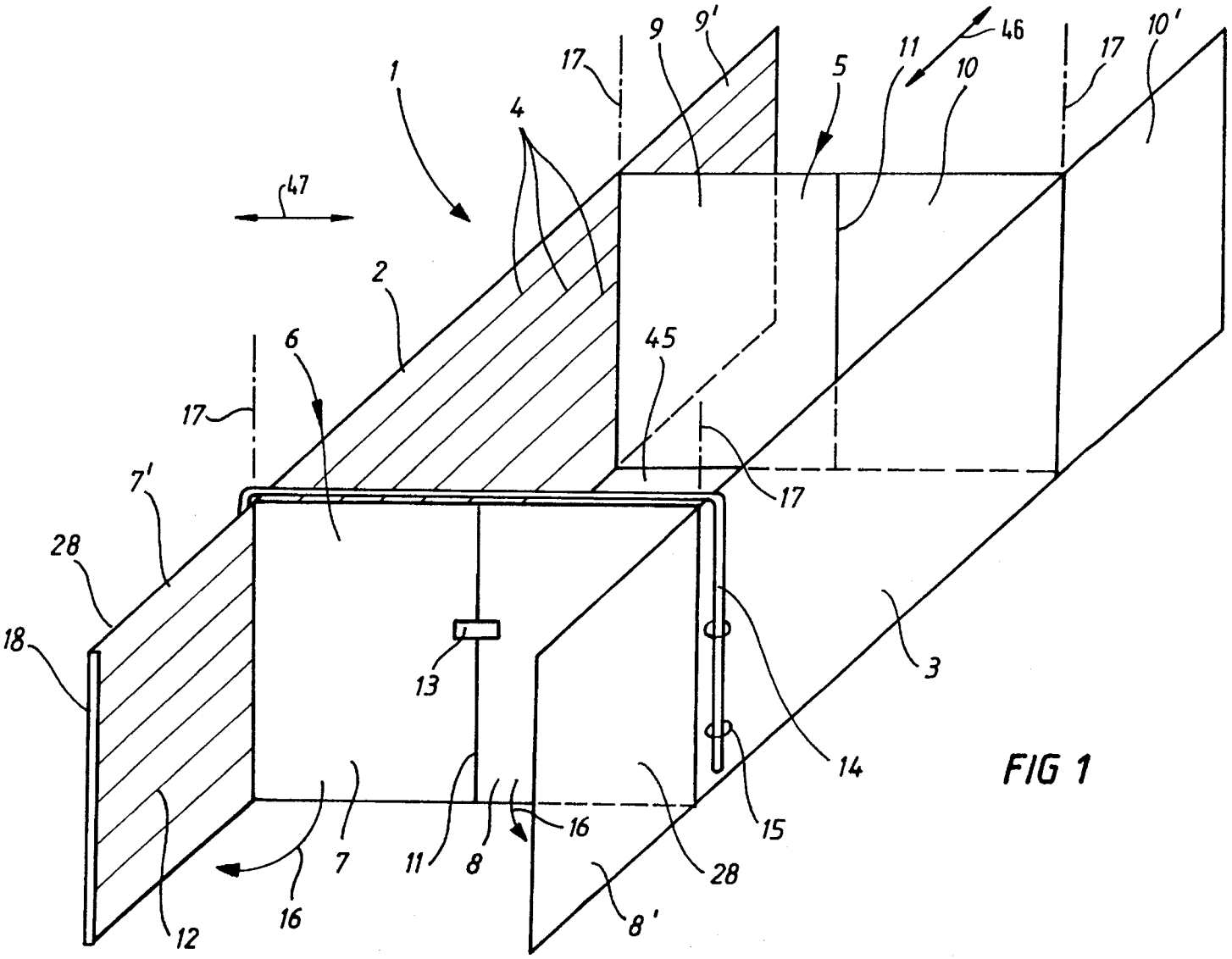
Figure 2:
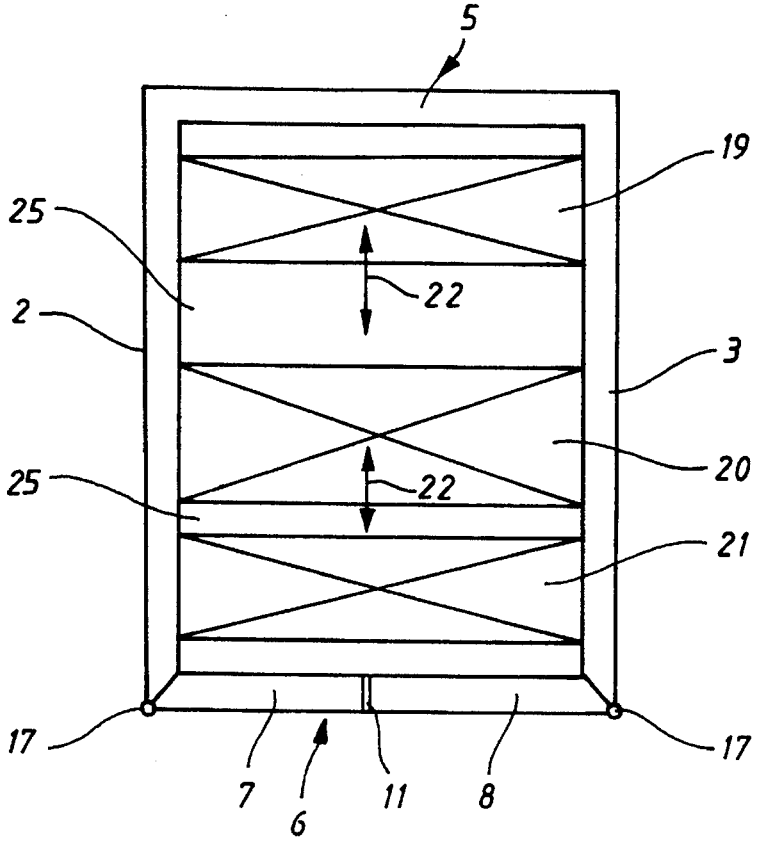
Figure 3:
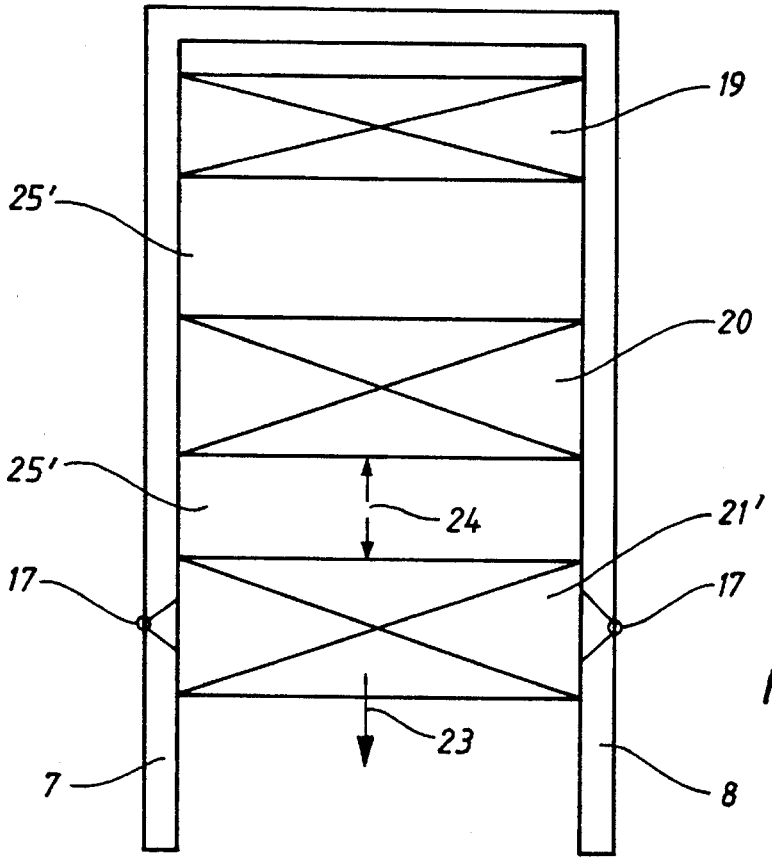
Figure 4:
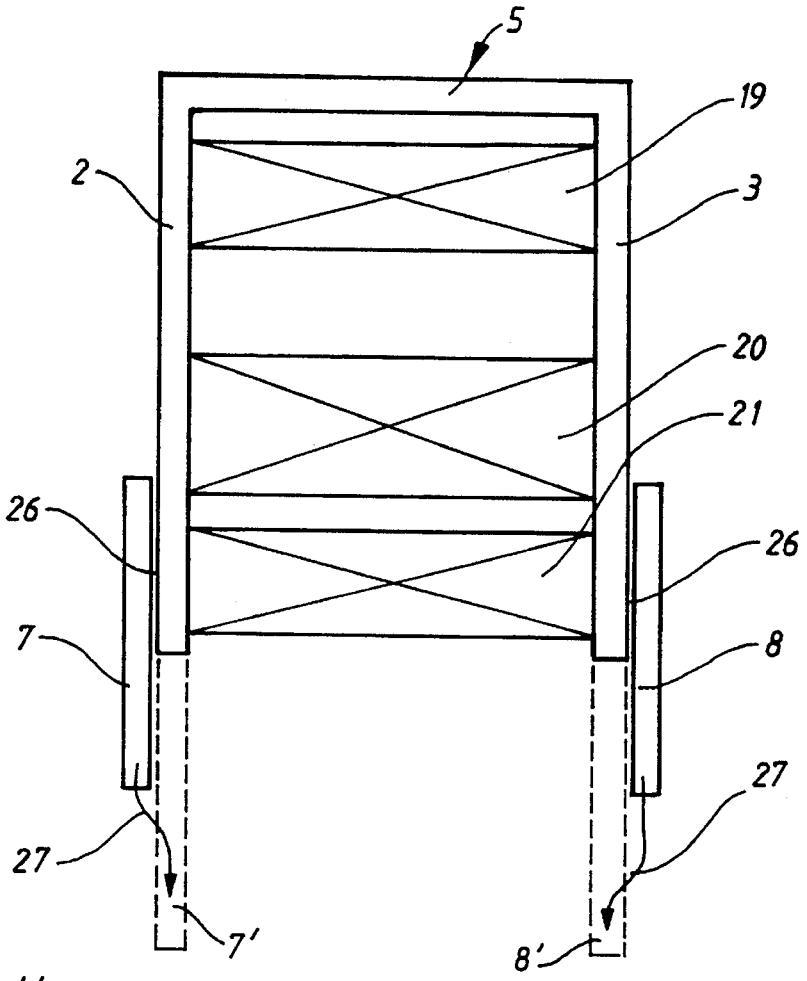
Figure 5:
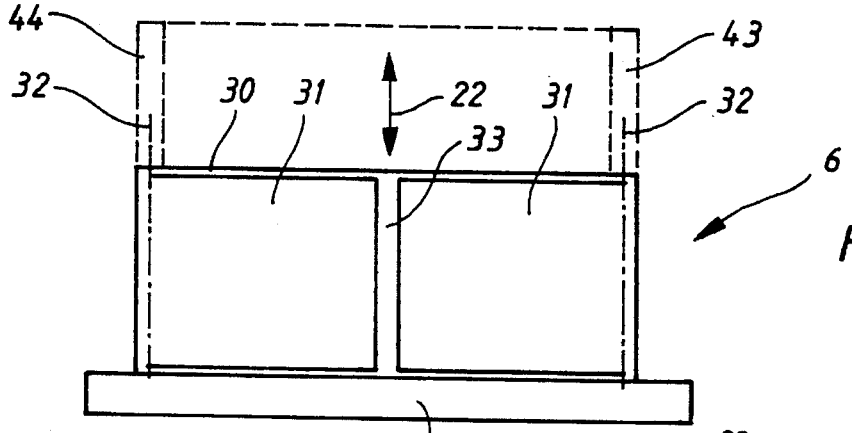
Figure 6:
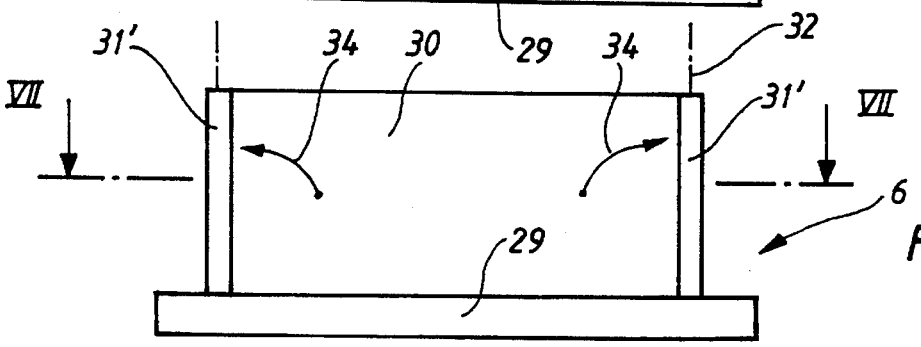
Figure 7:
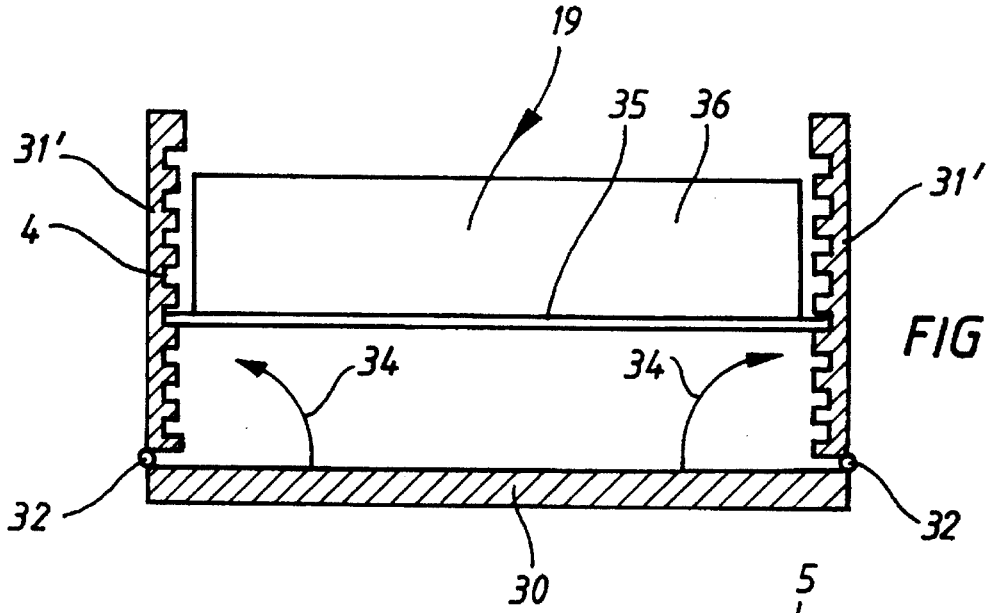
Figure 8:
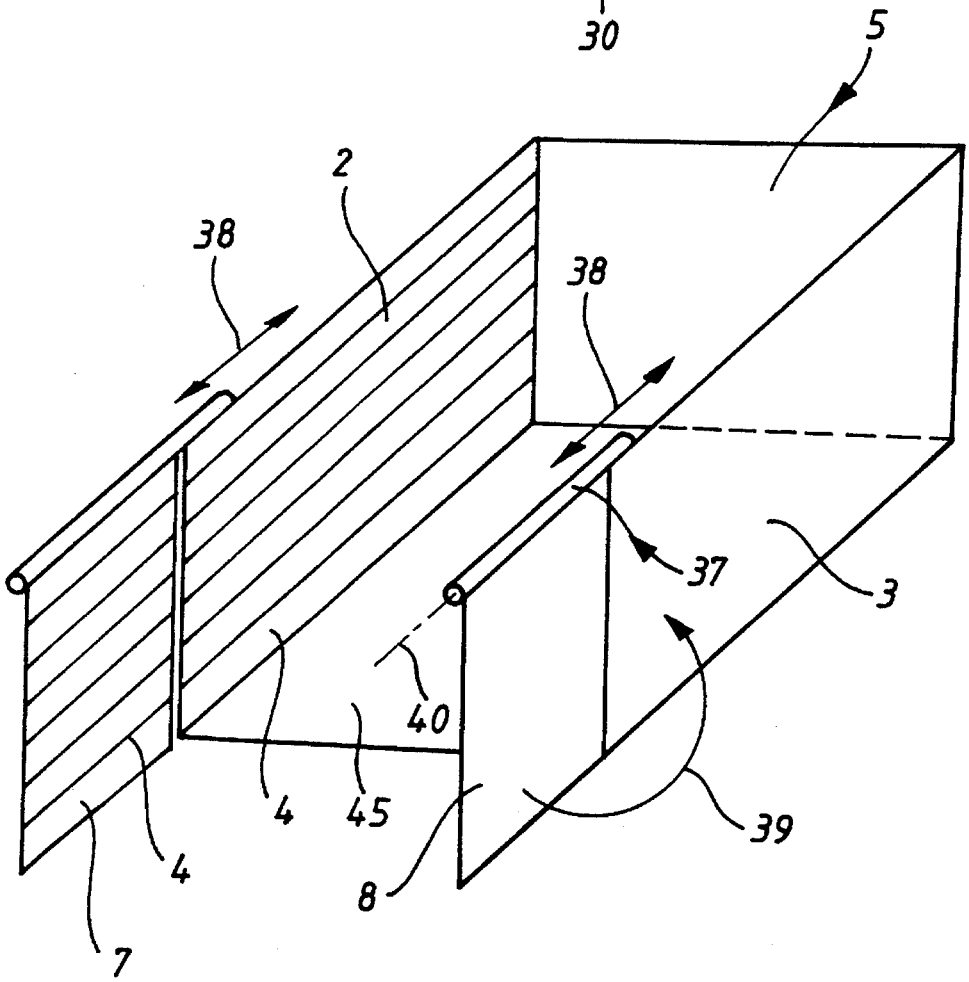
Figure 9:
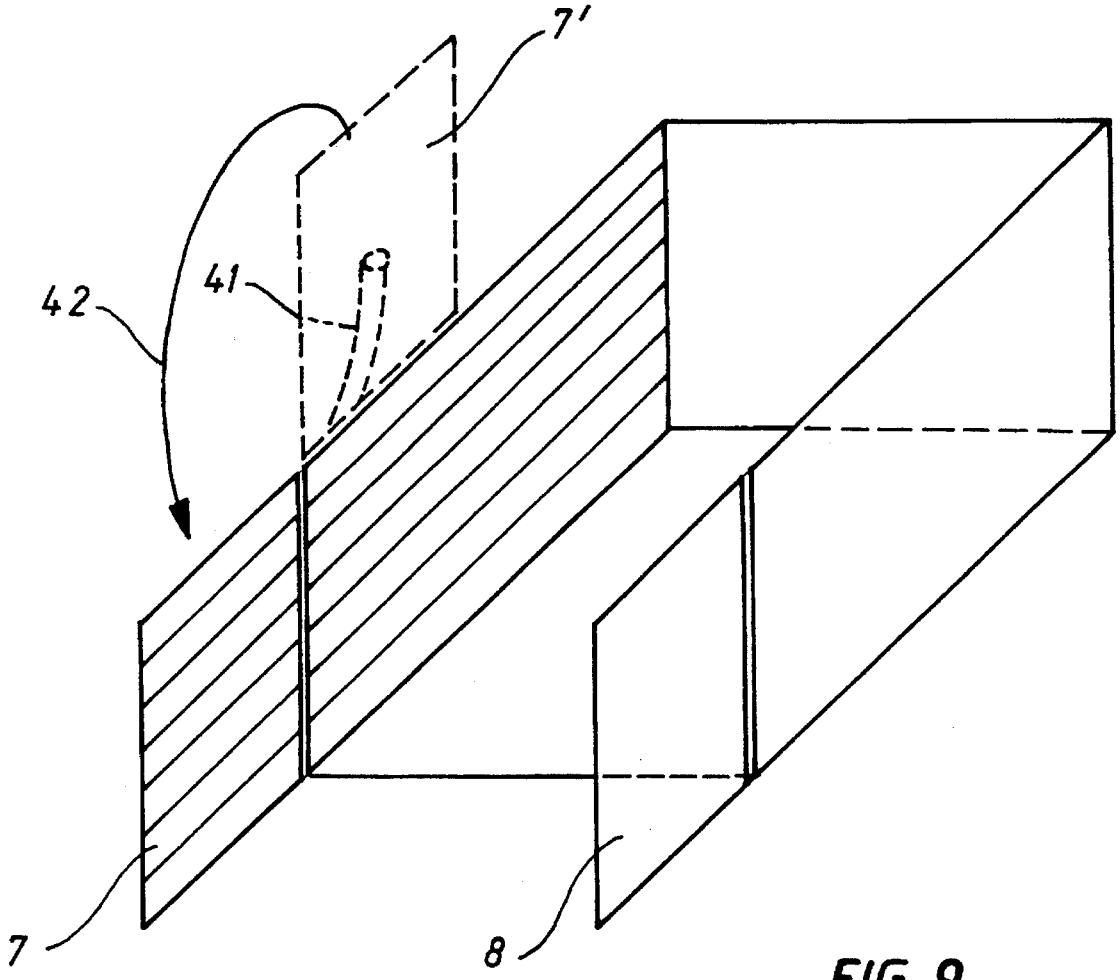
Figure 10:
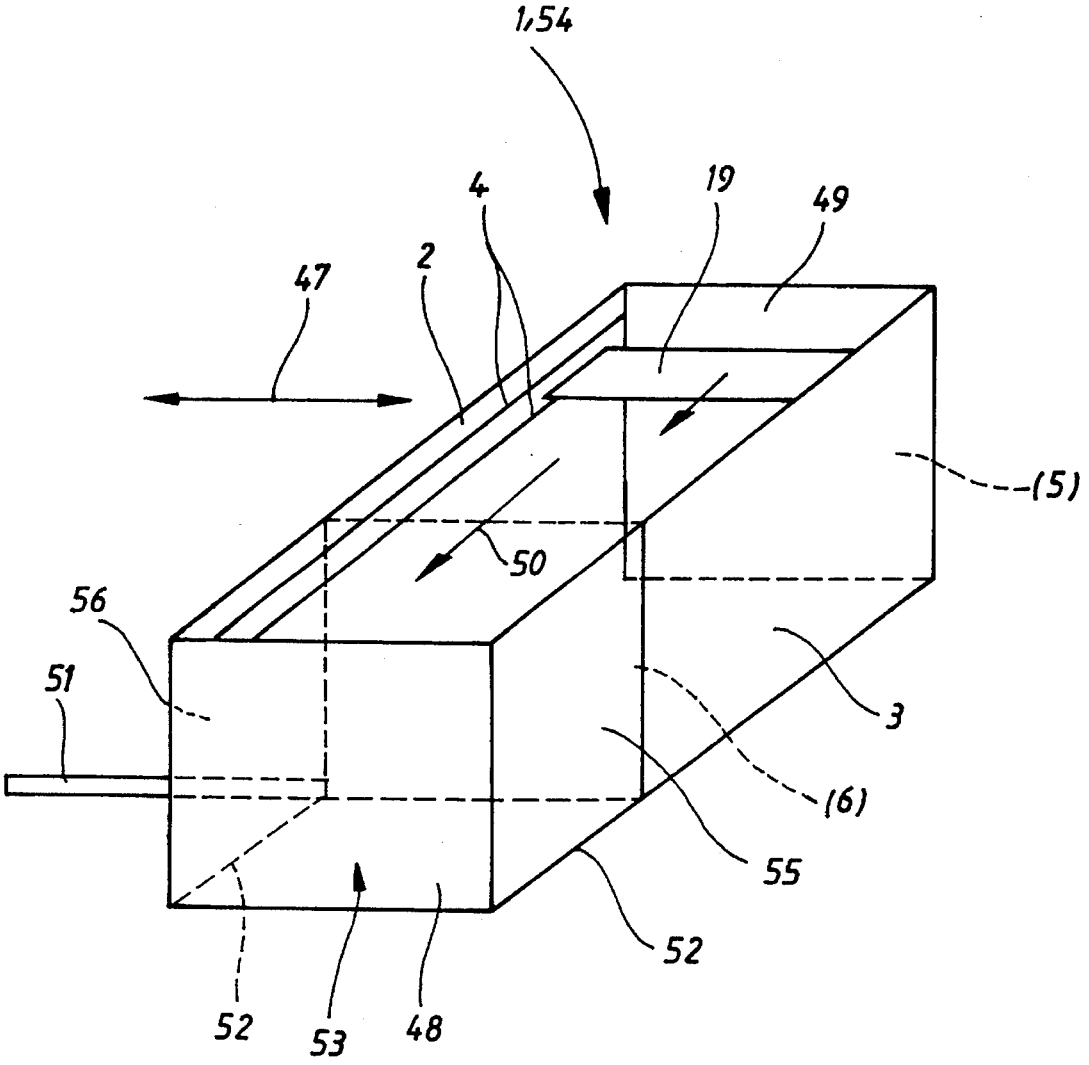

Shown are in:

FIG. 1: a storage chest of the invention perspectively and schematically,

FIG. 2: the storage chest in accordance with FIG. 1 in a modified embodiment in a top view and in the position of rest, FIG. 3: the storage chest in accordance with FIG. 2 in the position of use, FIG. 4: a modified embodiment of a storage chest in comparison with FIG. 3, FIG. 5: the top view of a front wall of a further embodiment of a storage chest in the tilted-shut state, FIG. 6: a top view of the front wall in accordance with FIG. 5 in the tilted-open state, FIG. 7: the section in accordance with line VII—VII in FIG. 6, FIG. 8: a further exemplary embodiment of a storage chest with a telescope like guidance of the front walls, FIG. 9: a further exemplary embodiment of a storage chest with a pivot guidance of the front walls, FIG. 10: a schematic view of a storage receptacle having transversely displaceable lateral walls, FIG. 11: a schematic view of a first embodiment of a storage receptacle which can be enlarged in the transverse direction, FIG. 12: a top view of a second embodiment of a storage receptacle which can be enlarged in the transverse direction.

DETAILED DESCRIPTION OF THE PREFERRED EMBODIMENT(S)

The storage chest 1 in accordance with FIG. 1 essentially consists of two lateral walls 2, 3 which are parallel to each other and to which respectively a rear wall 5 and a front wall 6 are vertically connected. Guide grooves 4 which are located opposite each other are cut into the lateral walls 2, 3. Regarding the further description of this storage chest, reference is made to the disclosure of EP 0 190 237 1, the contents of which disclosure is incorporated by reference into the present disclosure.

In accordance with the invention, the front wall 6 is divided and forms a central vertical parting line 11, because of which two front parts 7, 8 are formed which are pivotably maintained at the front edges of the lateral walls 2, 3 in the area of vertical hinge axes 17.

Incidentally, the same embodiment relates to the rear wall 5, which is divided into two rear wall parts 9, 10. In the closed state the two front wall parts 7, 8 as well as the rear wall parts 9, 10 are closed by a closure 13, which is merely schematically indicated.

For making the transition into the position of use, the closure 13 is opened and the front wall parts 7, 8 are pivoted outward in the direction of the arrow 16 around the hinge axes 17, so that they take up their position 7', 8'.

In this connection it can be provided that the outsides of the front wall parts 7, 8 are connected with a corresponding front panel half 28 in order to achieve a furniture-like impression.

The guide grooves 12 are disposed on the insides of the front wall parts 7, 8, which in the pivoted-out state of the front wall parts 7, 8 are aligned with guide grooves 4 located on the inside of the lateral walls 2, 3.

Now, if a receptacle (not shown in detail) is displaced in the interior of the storage chest 1, it can be displaced forward past the front edge of the storage chest 1 along guide grooves 4 and 12 into the area of the opened front wall parts 7, 8. This results in a considerable enlargement of the usable space in the storage chest.

In this connection it can be provided that appropriate detents 18 are provided on the front surfaces of the front wall parts 7, 8 in order to prevent an unintentional pulling-out of the receptacles 19, 21.

In the same way it has been provided that the pivoted-open pivot position of the front wall parts 7, 8 is arrested in order to assure the aligned agreement of the guide groove 4 with the associated guide groove 12.

In the same way it can be provided that one or several transverse rods 14 are used to stabilize the storage chest, which project over a storage chest 1 and are held in oppositely located guides 15 of the lateral walls 2, 3.

FIGS. 2 and 3 show top views of the arrangement in accordance with FIG. 1, wherein for the sake of simplicity the rear wall 5 is no longer shown in its pivoted-open position.

The storage or rest position is shown in FIG. 2, wherein it can be seen that access openings 25 are provided between individual receptacles 19 to 21, so that the storage chest in accordance with FIG. 2 is already usable per se.

However, it can be provided that the access openings 25 are reduced to zero for all practical purposes, which results in a maximal storage volume, so that the receptacles arranged in the storage chest in accordance with FIG. 2 lie close together and no longer can be displaced in respect to each other in the direction of the arrows 22.

Now, in order to make possible an advantageous access to individual receptacles in different planes, wherein the receptacles can also overlap each other in various planes, it is provided in accordance with FIG. 3 that the front wall 6 can be opened in the form of front wall parts 7, 8 and then takes up its pivot position in accordance with FIG. 3.

In accordance with FIG. 3 it is now possible to pull one or several receptacles seated near the front wall 6 forward in the direction of the arrow 23 into the area of the front wall parts 7, 8, which results in greater distances 24 between the individual receptacles, and in that the access openings 25 as a whole are enlarged to form access openings 25'.

A further exemplary embodiment of the invention is illustrated in FIG. 4, wherein it can be seen that the front wall parts 7, 8 are not pivotable around vertical axes 17, instead in this exemplary embodiment the front wall parts are guided parallel to the planes of the lateral walls 2, 3, wherein a connecting link guide 26 is used, so that the front wall parts 7, 8 seated on the outsides of the lateral walls 2, 3 can be displaced forward in the area of this connecting link guide in the direction of the arrow 27 into aligned continuation of the lateral walls 2 3 They then take up their position 7', 8'.

In place of the lateral wall guidance here described, it is also possible not to guide these front wall parts on the outside of the lateral walls 2, 3, but in the profile of the lateral walls 2, 3, and to pull the said front wall parts 7, 8 out of this profile of these lateral walls 2, 3 and move them back in again.

A further exemplary embodiment is shown in FIGS. 5 to 7, which avoids guides in the storage chest 1 itself as well as such pivot axes, because the entire arrangement is disposed on a bottom panel 30.

It is shown in FIGS. 5 and 6 that horizontal hinge axes 32 are disposed on the edges of a bottom panel 30, on which the lower ends of lateral doors are pivotably seated. Again there is a parting line 33 between the tilted-in lateral doors, wherein, in the position of storage or rest, the lateral doors 31 are resting parallel to the plane of the bottom panel 30 on the latter.

In this position of rest the entire bottom panel 30 can be inserted from the front into the storage chest or tilted and pushed in, in which case respective front walls 6 or rear walls 5 are lacking.

In this connection it can be provided that a front panel 29 is disposed on the front side of the bottom panel which, in the inserted state of the bottom panel, covers the front of the storage chest 1 in the manner of a door of a piece of furniture.

In accordance with FIG. 5, the base panel is connected with an extension shelf 43 in the direction toward the interior of the storage chest 1, which extension shelf remains in the area of the guide grooves 4 of the lateral walls 2, 3 when the entire arrangement in accordance with FIGS. 5 and 6 is pulled out toward the front from the front edge of the storage chest. It is subsequently possible to pivot open the tilted-in lateral doors 31 in the direction of the arrow 34 and they then take up their position in accordance with FIGS. 6 and 7, because of which it is also possible to pull appropriate receptacles 19 toward the front out of the storage chest. In a manner known per se, the receptacle 19 consists of a bottom panel 35 and corresponding front and rear walls 36, wherein the bottom panel 35 engages the guide grooves 4 and is displaceable therein in accordance with the specification of the older EP patent.

In place of a continuous flat extension shelf 43, it is also possible to employ a strip-shaped extension shelf, in which case only the extender strips 44 which engage the associated guide grooves in the lateral walls 2, 3 remain stationary.

The thickness of the bottom panel and of the parallel lateral doors 31 pivoted open on it or the lateral sides themselves can be selected to be such that the entire arrangement can be arbitrarily displaced in the interior of the storage chest 1, in which case the front panel 29 can be omitted.

It should also be pointed out that in place of the bottom panel herein described it is possible to use a cover panel in an analogous manner, so that the lateral doors are not pivoted upward in the direction of the arrows 34, but are pivoted down in a kinematic reversal and the bottom panel is embodied as a cover panel.

In an expansion of the exemplary embodiment in accordance with FIGS. 5 to 7 it can be provided that the bottom panel 30 is also omitted and that the said extender strips 44 are extended toward the front practically as far as the front panel 29 and are connected with it there. It is only important that the described hinge axes are disposed in the area of the extender strips in order to assure the pivoting of the lateral doors around respectively horizontal axes.

As a further exemplary embodiment FIG. 8 shows a telescopic displacement of the front wall parts 7, 8 in the area of respectively one telescopic guide 37. In this case a telescopically displaceable pipe would be seated, displaceable in the direction of the arrows 38, at the top of the lateral walls 2, 3, and the front wall parts 7, 8 are pivotable around the longitudinal axes 40 of the telescopic guides 37 by a pivot angle of 360°, for example.

In the first embodiment of this design, in the position of rest each front wall part 7, 8 would be pivoted toward the lateral walls 2, 3 in the pivot direction 39, so that the front wall parts 7, 8 lie parallel to the bottom surface 45 of the storage chest 1.

It should be noted that it is not necessarily required to equip the storage chest 1 with bottom surfaces 45; these bottom surfaces 45 can also be omitted. However, the bottom surfaces 45 are assumed for reasons of better geometric correspondence.

In a further pivot guide in accordance with FIG. 8 it is provided that in the position of rest the front wall parts 7, 8 are located parallel to the planes of the lateral walls 2, 3 on the outside at a small distance from the lateral walls, that in that case the telescopic guide is pulled out toward the front and that then the front wall parts 7, 8 are pivoted around the longitudinal axes 40 by 360° toward the inside in order to also arrive at the position of use in accordance with FIG. 8.

In FIG. 9 it is shown as a further exemplary embodiment that the front wall parts 7, 8 can also be carried in the area of pivot guides 41, wherein each front wall part 7, 8 is pivoted in the direction of the arrow 42 from a raised position 7' (or 8') into its lowered position 7. A pivot guide of this type is known from sewing boxes, tool chests, and the like and consists of pivot arms which are connected with each other in the manner of a scissors and put such a pivot guide 41 into effect.

The advantage also ensues with the storage system in accordance with the invention that practically the entire interior of a storage chest or piece of furniture can be filled with boxes, wherein these boxes are embodied as drawers for papers, for example, which contain various papers and which are placed horizontally on top of each other so they overlap. In the state of rest only the papers lying on top could be accessed.

To make the lower paper drawers accessible, it is provided in accordance with the invention to open the front wall or the rear wall or both walls in accordance with the principle of the invention in order to be able to pull out individual paper drawers toward the front or toward the back to obtain access to all paper drawers.

The paper drawers can also be pulled completely out of the storage chest toward the front.

It is again pointed out that the principle of the invention does not only operate in connection wit a storage chest, but can be integrated into a part of a piece of furniture itself, wherein the described guide grooves 4 are a part of the lateral walls of the piece of furniture. In place of the described guide grooves which are disposed in the lateral walls and continue into the front and rear walls, it is also possible to use appropriate guide rails which are separately fastened on the insides of the pieces of furniture.

In FIG. 10 a combination of a longitudinal drawer 54 with associated crosswise displaceable transverse drawers 53 is illustrated as an exemplary embodiment. For the sake of simplicity, only a single transverse drawer 53, which can be pulled out of the longitudinal drawer 54 in the direction of the arrow 50, is shown in FIG. 10.

It is essential in this case that the storage chest 1, which previously has been described in all of its various embodiments, is maintained displaceable on telescoping rails 51 in the body of a piece of furniture and accordingly can be pulled out of the body of the piece of furniture in the pull-out direction 47. Transverse drawers 53 are disposed, displaceable crosswise to the pull-out direction 47, in this storage chest 1, which should be called a longitudinal drawer 54.

The lateral walls are also freed as soon as the longitudinal drawer 54 has been completely pulled out of the body of the piece of furniture.

To remain within the nomenclature of the preceding exemplary embodiments, it has been provided here that now the previous lateral wall 3 forms the front wall of the longitudinal drawer 54, while the original lateral wall 2 forms the rear wall of the longitudinal drawer 54.

Accordingly, the wall parts which previously were indicated as front and rear walls 5, 6 in this exemplary embodiment can be displaced crosswise to the pull-out direction 47 in the direction of the arrows 50.

In this case it is provided that the front wall 55 and the rear wall 56 are displaceably carried on associated transverse rails 52 in the longitudinal drawer 54, so that the totality of the mentioned parts constitutes a transverse drawer 53 together with the lateral wall 48, which can be pulled out of the storage chest 1 in the direction of the arrow 50 and pushed back in again in the opposite direction thereto.

This results in a considerable space gain, because with the transverse drawers 53 pushed in, the storage chest 1 is compactly filled with respective receptacles 19 to 21, of which only one receptacle 19 has been illustrated.

As soon as the storage chest 1 with the transverse drawers 53 still pushed in is completely pulled out of the body of the piece of furniture, the width of the storage chest 1 can be considerably increased, namely in that the two transverse drawers (of which only the transverse drawer 53 is illustrated) are pulled out crosswise to the pull-out direction, namely in the direction of the arrow 50.

The same transverse drawer ensues in the area of the lateral wall 49.

Regarding the exemplary embodiment of FIG. 1 and all other exemplary embodiments, the present invention includes as important to the invention that the storage chest 1 can either be pulled out of a drawer in the pull-out direction 46 in order to open the respective doors which are accessible from the front and/or to pivot them.

However, in another embodiment it is provided that the storage chest 1 is disposed in the body of a piece of furniture in the pull-out direction 47 and accordingly can be displaced out of the body of the piece of furniture, wherein in this exemplary embodiment the walls 8 to 10, which are to be opened and pivoted, must be opened in the transverse direction to the pull-out direction 47.

Thus, this exemplary embodiment—which will be described in detail by means of FIGS. 10 to 12, concerns a longitudinal drawer 54 in which transverse drawers 53 have been displaceably arranged.

Figures 11A, 11B:
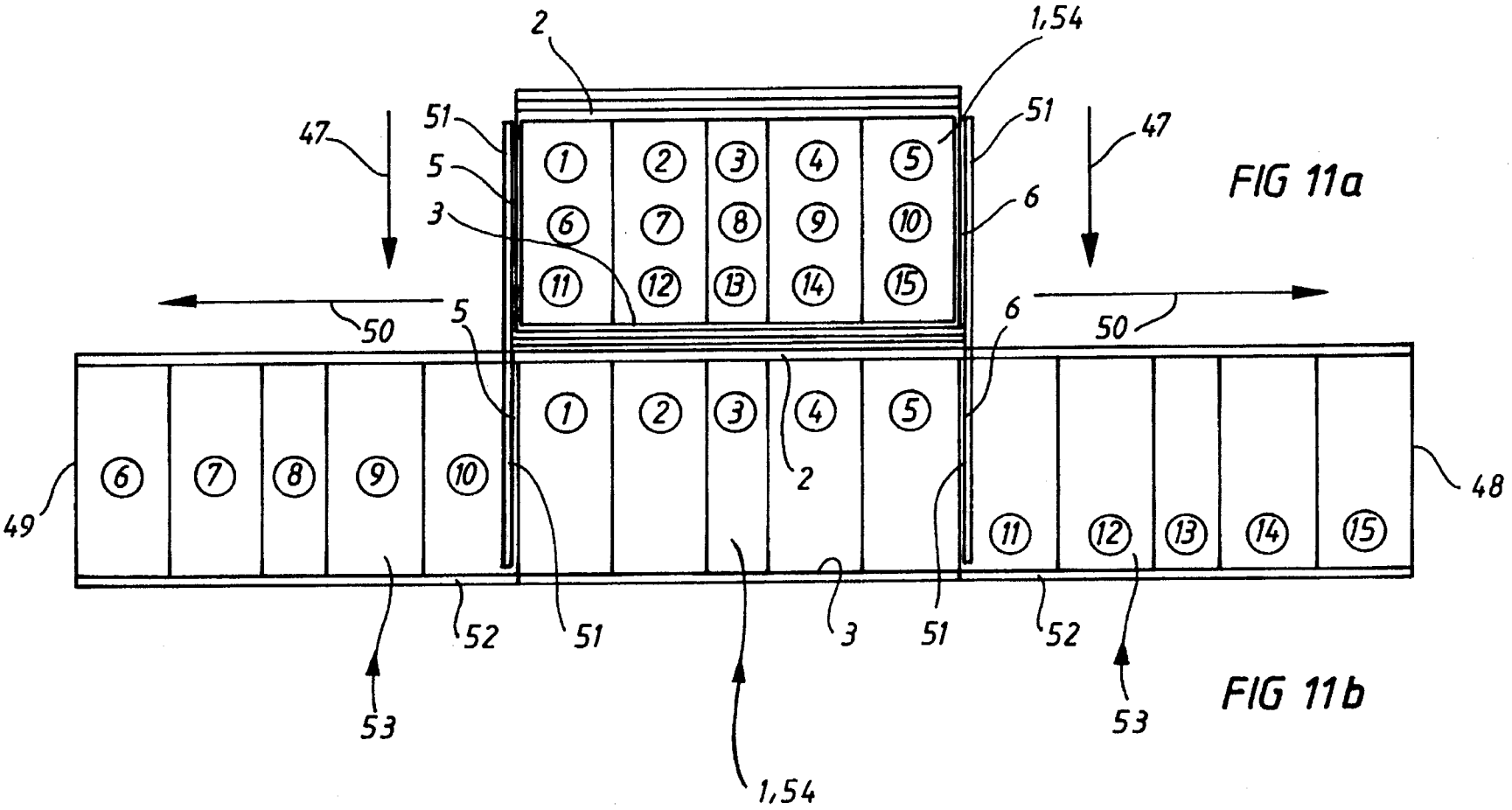

It is shown in FIG. 11*a* that in the pushed-together state the storage chest 1 represents a compact design, wherein the positions of the individual receptacles are designated by reference numerals 1 to 15.

Now, as soon as the compact storage chest 1 in FIG. 11*a* has been pulled out of the body of a piece of furniture in the pull-out direction 47, it can be unfolded to the sides in accordance with FIG. 11*b*.

In accordance with the previous description of FIG. 11, it is possible to pull the previously mentioned transverse drawers 53 out of the longitudinal drawer 54 to the left and right in the direction of the arrows 50, wherein the receptacles which previously were indicated by the position numbers 1 to 15 now take up their new positions in accordance with FIG. 11*b*.

Figure 12A:
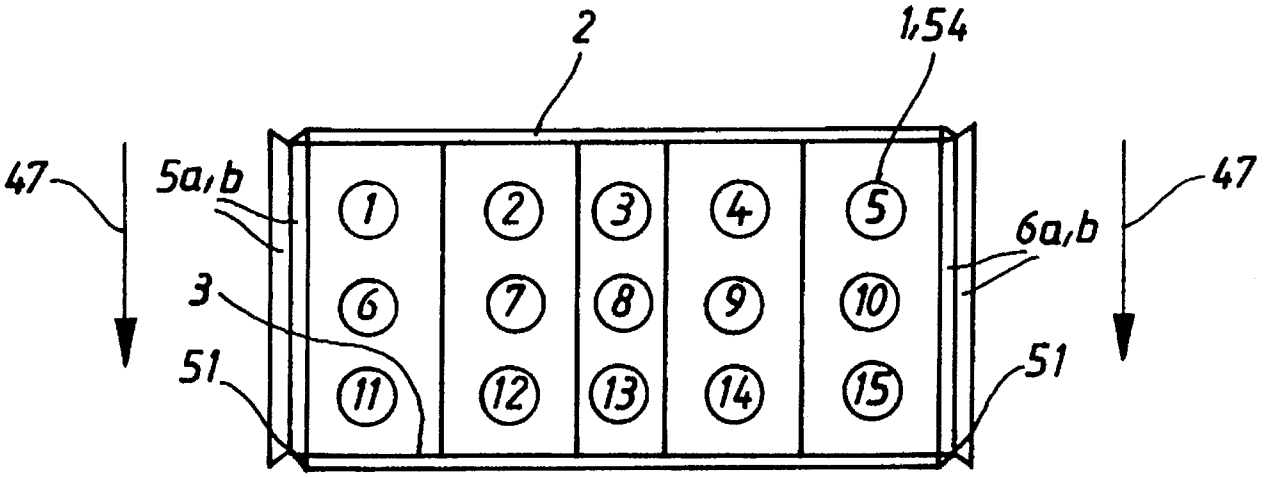
Figure 12B:
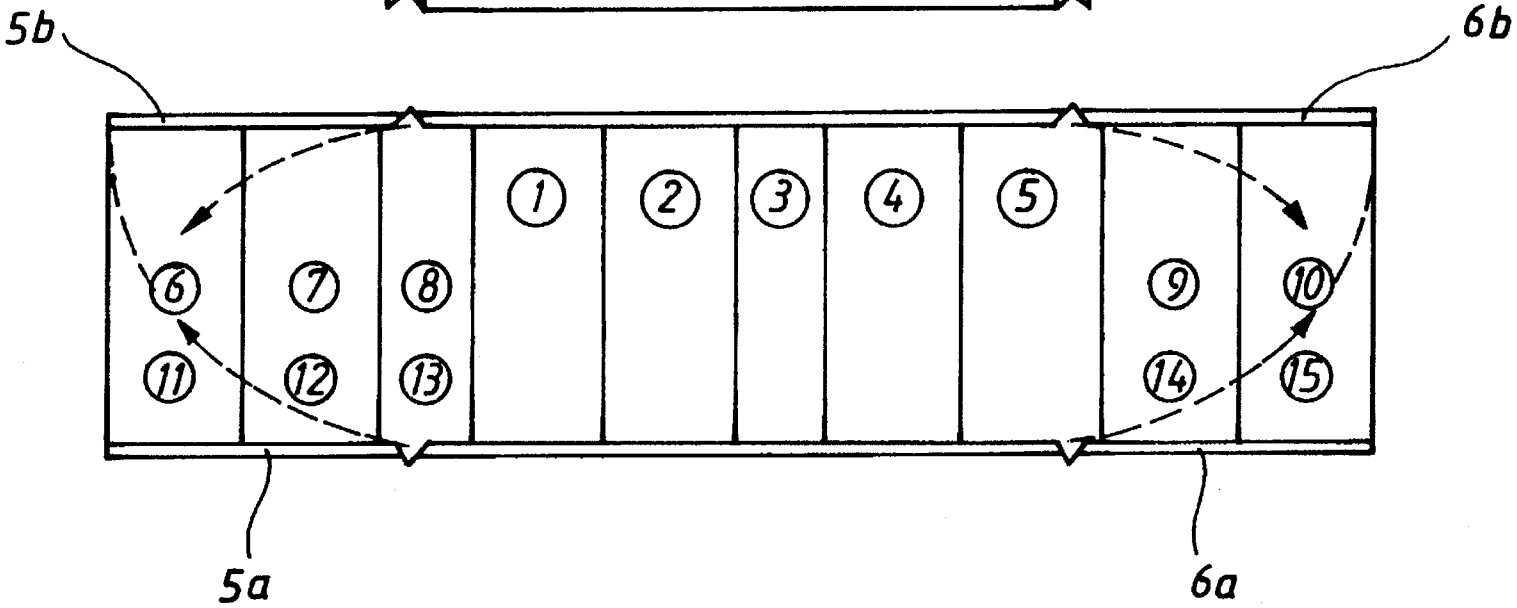

The same relationships are illustrated in FIGS. 12*a*, 12*b* in connection with another exemplary embodiment.

Here, too, the storage chest 1 is shown in FIG. 12*a* in the pushed-in state, while in FIG. 12*b* the storage chest 1 is shown pulled out of the body of a piece of furniture and unfolded in the transverse direction.

However, in contrast to the exemplary embodiment of FIG. 11, the walls 5, 6 are not seated displaceable on telescopic rails 51, instead they are pivotably seated, as is illustrated in FIG. 1 in respect to the hinge axes 17.

The respective doors overlap in the form of the front walls 6*a*, 6*b* and the rear walls 5*a*, 5*b* and accordingly can be completely tilted out in accordance with FIG. 12*b* in order to take up their position in accordance with FIG. 12*b*.

The result of a comparison between FIG. 11*a* with FIG. 11*b* or 12*a* with 12*b* is that instead of five storage receptacles (FIGS. 11*a*, 12*a*) which were previously accessible in the closed state of the chest, when changing to FIGS. 11*b* or 12*b* a total of fifteen receptacles become accessible instead of the previously five which were accessible.

The great gain in access and accessibility of the individual receptacles is the result of this.

Drawing Figure Legend

| | |
|---|---|
| 1 Storage Chest | 26 Connecting link guide |
| 2 Lateral wall | 27 Direction of arrow |
| 3 Lateral wall | 28 Front panel half |
| 4 Guide groove | 29 Front panel |
| 5 Rear wall | 30 Bottom panel |
| 6 Front wall | 31 Lateral door |
| 7 Front wall part | 32 Hinge pin |
| 8 Front wall part | 33 Parting line |
| 9 Rear wall part | 34 Direction of arrow |
| 10 Rear wall part | 35 Bottom panel |
| 11 Parting line | 36 Front wall |
| 12 Guide groove | 37 Telescopic guide |
| 13 Closure | 38 Direction of arrow |
| 14 Transverse rod | 39 Pivot direction |
| 15 Guide | 40 Longitudinal axis |
| 16 Direction of arrow | 41 Pivot guide |
| 17 Hinge pin | 42 Direction of arrow |
| 18 Detent | 43 Extension shelf |
| 19 Receptacle | 44 Extender strip |
| 20 Receptacle | 45 Bottom surface |
| 21 Receptacle | 46 Pull-out direction (1st variant) |
| 22 Direction of arrow | 47 Pull-out direction (2nd variant) |
| 23 Direction of arrow | 48 Lateral wall |
| 24 Distance | 49 Lateral wall |
| 25 Access opening 25' | 50 Direction of arrow |
| | 51 Telescoping rail |
| | 52 Transverse rail |
| | 53 Transverse drawer |
| | 54 Longitudinal drawer |
| | 55 Front wall |
| | 56 Rear wall |

I claim:

1. A storage receptacle with a rear wall and a front wall as well as two lateral walls, in which guide rails are provided at equal heights, said guide rails engaging a plurality of further receptacles fitted in the storage receptacle for slidable movement, the plurality of further receptacles provided in said storage receptacle having different volumes and able to fill up the whole interior space of said storage receptacle, said further receptacles being slidably mounted in several planes one above the other and also one behind the other in said storage receptacle, by means of several guide rails provided at equal heights on said lateral walls, the height of some of Said further receptacles being greater than the distance between each of said guide rails, characterized in that at least one of the rear wall or front wall is embodied to be moveable and contains guide rails which, after movement of the at least one rear wall or front wall, align with the guide rails of corresponding adjoining wall of said lateral walls.

2. A storage receptacle in accordance with claim 1, characterized in that the outside of the walls is encased in the manner of a piece of furniture.

3. A storage receptacle in accordance with claim 1, characterized in that the at least one of the front wall or rear wall is vertically divided and is embodied be pivotable around a vertical axis at a connecting point with the corresponding adjoining lateral wall of the lateral walls, and that the guide rails of the at least one of the rear wall or front wall which is pivotable, lengthen those of the corresponding adjoining wall.

4. A storage receptacle in accordance with claim 1, characterized in that the front wall is maintained at the lateral walls by means of telescopic guides and in their position of rest are selectively pivotable parallel in relation to the bottom surface and/or top surface or are maintained parallel to the lateral wall.

5. A storage receptacle in accordance with claim 1, characterized in that the at least one of the rear wall or front wall which is moveable is embodied as a wall parallel to the lateral walls and can be pushed into them.

6. A storage receptacle in accordance with claim 5, characterized in that the parallel wall is displaceable via a connecting link guide.

7. A storage receptacle in accordance with claim 1, characterized in that the lateral walls are disposed on horizontal pivot axes on a bottom panel, which bottom panel is pivotable maintained in guide grooves of lateral walls.

8. A storage receptacle in accordance with claim 1, characterized in that the divided front wall is fastened in pivot guides on the lateral walls and can be brought in a pivot movement, which is directed parallel to the lateral walls, from an upper into a lower, let down position which extends the lateral walls toward the front in alignment.

9. A storage receptacle with a rear wall and a front wall as well as two lateral wall, in which guide rails are provided at equal heights for receiving and moving further receptacles fitted in the storage receptacle, in accordance with claim 1, characterized in that guide rails and fastening devices are provided on the outer surfaces of the walls for pushing the storage receptacle into another suitable device.

10. A storage receptacle in accordance with claim 9, characterized in that the movement of the walls (7 to 10) takes place in the pull-out direction (46) of a drawer.

11. A storage receptacle in accordance with claim 9, characterized in that the displacement of the storage chest (1) first takes place in the pull-out direction (47) of the drawer, and that the movement of the walls (7 to 10) takes place in the vertical direction in respect to the pull-out direction (47) of the drawer.

12. A storage receptacle in accordance with claim 1, characterized in that a bottom and a tip wall are provided.

13. A storage receptacle in accordance with claim 12, characterized in that at least one of the front wall or rear wall is vertically divided and is embodied to be pivotable around a vertical axis at a connecting point with the corresponding adjoining lateral wall of said lateral walls, and that the guide rails of the at least one of the rear wall or front wall which is pivotable, lengthen those of the corresponding adjoining wall.

14. A storage receptacle in accordance with claim 12, characterized in that the front wall is maintained at the lateral walls by means of telescopic guides and in their position of rest are selectively pivotable parallel in relation to the bottom surface and/or top surface or are maintained parallel to the lateral wall.

15. A storage receptacle in accordance with claim 12, characterized in that the at least one of the rear wall or the front wall is embodied as a wall parallel to the lateral walls and can be pushed into them.

16. A storage receptacle in accordance with claim 2, characterized in that the lateral walls are disposed on horizontal pivot axes on a bottom panel, which bottom panel is pivotably maintained in guide grooves.

17. A storage receptacle in accordance with claim 2, characterized in that the divided front wall is fastened in pivot guides on the lateral walls and can be brought in a pivot movement, which is directed parallel to the lateral walls, from an upper into a lower, let down position which extends the lateral walls toward the front in alignment.

18. A storage receptacle in accordance with claim 17, characterized in that the outside of the walls is encased in the manner of a piece of furniture.

19. A storage receptacle in accordance with claim 1, characterized in that the movement of the walls (7 to 10) takes place in the pull-out direction (46) of a drawer.

20. A storage receptacle in accordance with claim 1, characterized in that the displacement of the storage chest (1) first takes place in the pull-out direction (47) of a drawer, and that the movement of the walls (7 to 10) takes place in the vertical direction in respect to the pull-out direction (47) of the drawer.

* * * * *